US006066802A

United States Patent [19]

Reinke et al.

[11] Patent Number: 6,066,802

[45] Date of Patent: May 23, 2000

[54] SAFETY ENCLOSURE SYSTEM FOR A TRANSFORMER

[75] Inventors: David A. Reinke, Jefferson; Anthony Lenzini, Columbia; Sam Samson, Westphalia, all of Mo.

[73] Assignee: ABB Power T&D Company Inc., Raleigh, N.C.

[21] Appl. No.: 09/157,793

[22] Filed: Sep. 21, 1998

[51] Int. Cl.[7] ..... H01J 5/00

[52] U.S. Cl. ..... 174/50; 174/58; 49/142; 220/4.02; 312/326; 336/90

[58] Field of Search ..... 174/50, 52.6, 58, 174/17 CT, 17 R, 66, 38, 39; 220/4.02, 3.94, 241; 312/326, 327, 328, 222; 52/515, 516; 49/142, 163; 336/90

[56] References Cited

U.S. PATENT DOCUMENTS

| | | | |
|---|---|---|---|
| 2,274,106 | 2/1942 | Strong et al. | 312/100 |
| 2,615,775 | 10/1952 | Claybourn et al. | 312/107 |
| 3,599,134 | 8/1971 | Galloway | 336/230 |
| 4,533,786 | 8/1985 | Borgmeyer et al. | 174/50 |
| 4,559,699 | 12/1985 | Owen et al. | 29/602 R |
| 5,036,488 | 7/1991 | Motarjemi | 365/52 |
| 5,739,464 | 4/1998 | Adkins et al. | 174/50 |
| 5,783,775 | 7/1998 | Marusinec | 174/50 |
| 5,789,828 | 8/1998 | Tremaine et al. | 307/64 |
| 5,889,231 | 3/1999 | Marusinec et al. | 174/50 |

FOREIGN PATENT DOCUMENTS

| | | | |
|---|---|---|---|
| 2191528 | 12/1987 | United Kingdom | 49/163 |

*Primary Examiner*—Kristine Kincaid
*Assistant Examiner*—Dhiru R Patel
*Attorney, Agent, or Firm*—Woodcock Washburn Kurtz Mackiewicz & Norris LLP

[57] ABSTRACT

A safety enclosure system for a transformer is disclosed including a high voltage enclosure used in conjunction with a flip top hood on pad mounted transformers to provide an additional access restriction to the high voltage compartment after the hood has been opened. The high voltage enclosure is designed such that it is secured to the barrier plate separating the high voltage terminals from the low voltage terminals and after opening the enclosure is swung to the side, out of the way, for any operations in the high voltage compartment. The enclosure must then be closed before the hood can be closed and locked. This provides increased security for any further access to the high voltage compartment.

5 Claims, 2 Drawing Sheets

SAFETY ENCLOSURE SYSTEM FOR A TRANSFORMER

BACKGROUND OF THE INVENTION

1. Field of the Invention

This invention relates in general to electrical transformer enclosures, and more specifically to a safety enclosure system for a pad mounted transformer of the distribution type.

2. Description of the Prior Art

Single phase and three phase, pad mounted transformers conventionally include a tank having an enclosure including a hood and sill which enclose high voltage terminals and low voltage terminals on the front wall of the tank. An example of prior art pad mounted transformer enclosures are shown in U.S. Pat. Nos. 4,533,786 and 5,739,464. In such patents it will be noted that when the hood or terminal cover is opened, both the high voltage terminals and the low voltage terminals are exposed. For the safety of the lineman working on the transformer unit it would be desirable to provide an additional access restriction to the high voltage compartment of the transformer after the hood has been opened.

SUMMARY OF THE INVENTION

It is an object of the present invention to provide a high voltage compartment cover that can be used in conjunction with the flip top hood on the single phase pad mounted transformers and the three phase transformers to provide an additional access restriction to the high voltage compartment after the hood has been opened. It is a further object of the invention to construct the compartment cover so that it can be secured to a barrier plate separating the high voltage and low voltage terminals and after opening the cover it can be swung to one side, out of the way, for any operations in the high voltage compartment. The cover must be closed before the hood can be closed and locked thus providing increased security for any future access to the high voltage compartment.

The present invention provides a safety enclosure system for a transformer having on the front thereof high voltage terminals and low voltage terminals. This system includes an outer thread for enclosing the high voltage terminals and the low voltage terminals, the outer hood being hinged at one edge thereof to the top of the front of the transformer for rotation about a horizontal axis between closed and open positions. A bolt for locking the outer hood in closed position is provided and a barrier plate is fixed to the front of the transformer and projects outwardly therefrom to separate the high voltage terminals from the low voltage terminals. A high voltage enclosure is hinged at one side to the front of the transformer opposite the barrier plate and covering the high voltage terminals to form a high voltage compartment. The opposite side of the high voltage enclosure is positioned adjacent the barrier plate when the high voltage enclosure is in closed position. A latch rod is pivotally connected at one end to the front of said transformer and removably connected at the other end to the high voltage enclosure for latching the high voltage enclosure in open position to expose the high voltage compartment, and a latch bolt is carried by the high voltage enclosure for securing the high voltage enclosure in closed position against the barrier plate. In one aspect of the invention, the barrier plate has slot structure in the outer end thereof for receiving the latch bolt to permit automatic closure of the high voltage enclosure by swinging the high voltage enclosure to closed position. In another aspect of the invention the high voltage enclosure is hinged to the front of the transformer by hinged assemblies constructed and arranged to permit the high voltage enclosure to be lifted off the transformer when the high voltage enclosure is in open position if necessary for maintenance.

BRIEF DESCRIPTION OF THE DRAWINGS

For a more detailed disclosure of the invention and for further objects and advantages thereof, reference is to be had to the following description taken in conjunction with the accompanying drawings, in which.

DESCRIPTION OF THE PREFERRED EMBODIMENT

Figure 1:
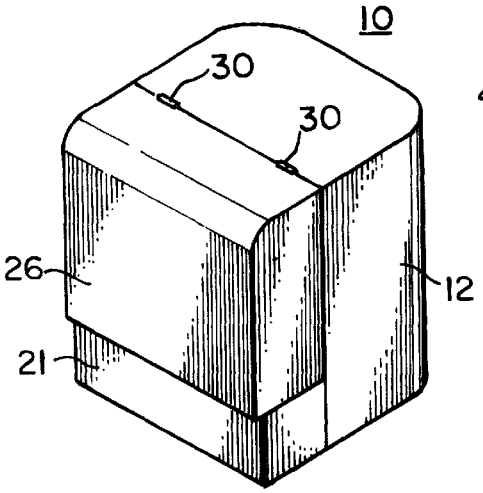
FIG. 1 is a perspective view of a pad mounted transformer embodying the present invention with the outer hood closed.
Figure 2:
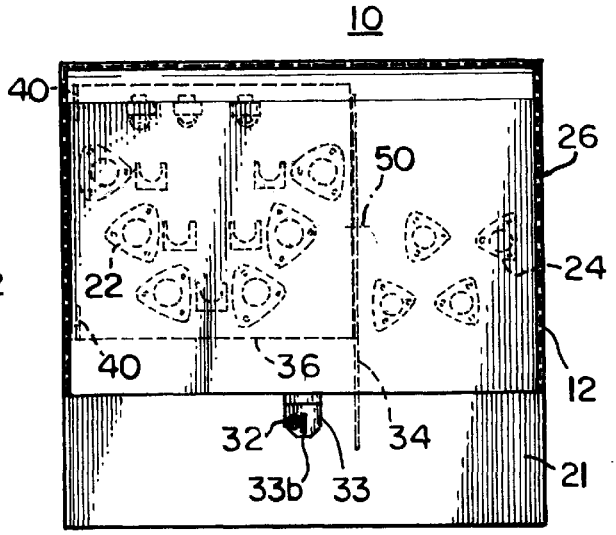
FIG. 2 is a front elevational view of the transformer illustrated in FIG. 1.
Figure 3:
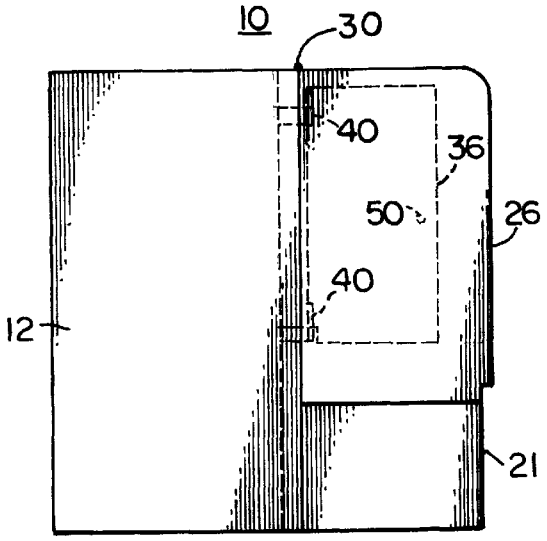
FIG. 3 is a left side elevational view of the transformer illustrated in FIGS. 1 and 2.
Figure 4:
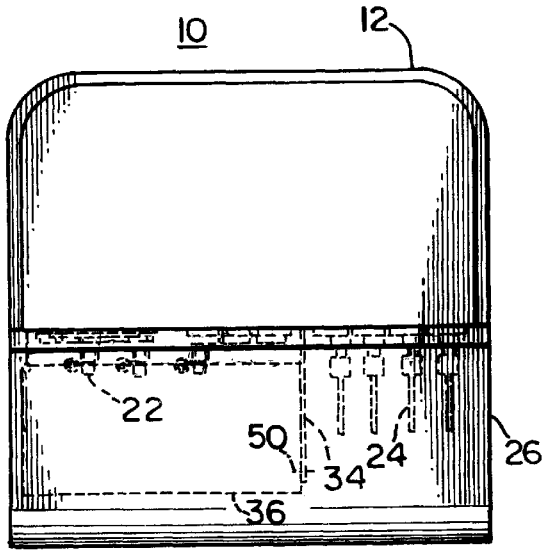
FIG. 4 is a top plan view of the transformer illustrated in FIGS. 1–3.
Figure 5:
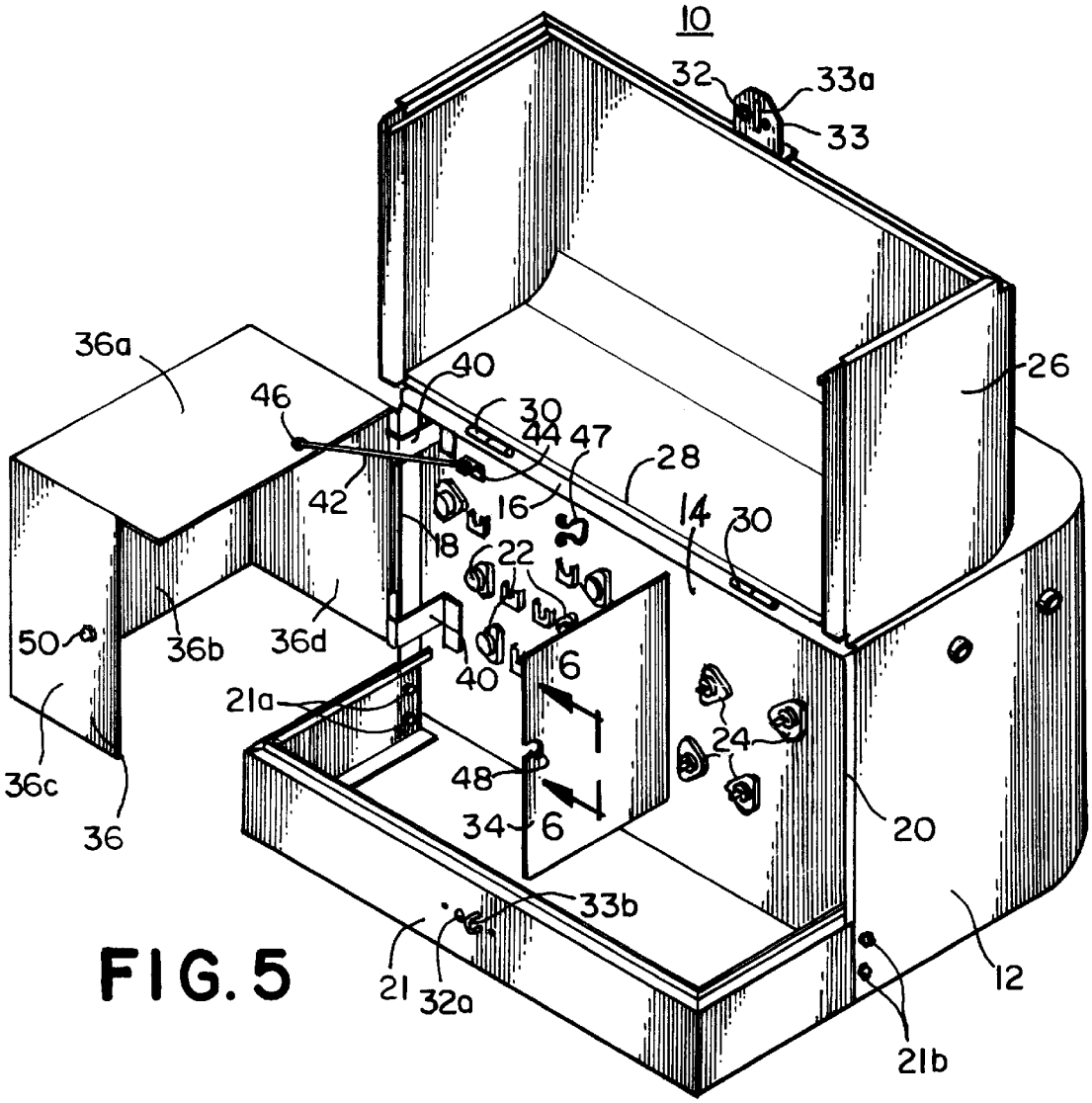
FIG. 5 is a perspective view of the transformer illustrated in FIGS. 1–4 with the outer hood and high voltage enclosure in open position.
Figure 6:
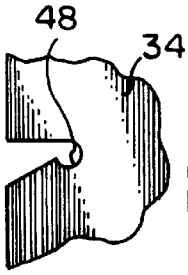
FIG. 6 is a fractional view on enlarged scale of the latch bolt slot in the barrier plate taken along the lines 6—6 in FIG. 5.

Referring to FIGS. 1–5 there is illustrated a pad mounted transformer 10 embodying the safety enclosure system of the present invention. The transformer 10 includes a tank 12 having a front wall 14, FIG. 5, including a top edge 16 and two side edges 18 and 20 to which is attached a sill 21. The front wall 14 has mounted thereon high voltage terminals 22 and low voltage terminals 24, FIG. 5, which are connected to a core-coil assembly (not shown) disposed within the tank. This construction is well known in the art and an example of which is illustrated in the aforesaid U.S. Pat. No. 4,533,786, the disclosure therein being incorporated herein by this reference thereto. An outer hood 26 is provided for enclosing the high voltage terminals 22 and the low voltage terminals 24. The outer hood 26 is hinged at one edge 28 by hinges 30 to the top edge 16 of the front 14 of the transformer tank for rotation about a horizontal axis between closed and open positions. The closed position is illustrated in FIGS. 1–4 and the open position is illustrated in FIG. 5. A pentahead bolt 32, FIGS. 2 and 5 is provided for locking the outer hood 26 in closed position to the sill 21. The bolt 32 is carried by a latch plate 33 fixed to the outer hood 26. The bolt 32 is adapted to be inserted in a nut 32*a* carried by the sill 21. The latch plate 33 includes a slot 33*a* for receiving a lock tab 33*b* carried by the sill 21. A barrier plate 34 is fixed to the front 14 of the transformer tank and projects outwardly therefrom to separate the high voltage terminals 22 from the low voltage terminals 24. A high voltage enclosure 36 which is a box-like structure open at the back and bottom thereof and having a top 36*a*, front 36*b* and two end walls 36*c*, 36*d* is hinged at one side to the front 14 of the transformer tank opposite the barrier plate 34. As may be seen in FIGS. 3 and 5 the end wall 36*d* is connected by hinge assemblies 40 to the front wall 14 of the tank. The hinge assemblies 40 are preferably of the type where the hinge pin is permanently attached to the lower hinge leaf thereby allowing the upper hinge leaf to be separated from the lower hinge leaf without loss of the hinge pin and allowing the high voltage enclosure 36 to be lifted off the transformer unit if necessary for maintenance.

For the safety of the lineman working on the transformer unit, the high voltage enclosure 36 has a latch rod 42 pivotally connected at one end 44 to the front wall 14, FIG. 5. The other end of the rod 42 is inserted in a hole 46 in the top 36*a* of the high voltage enclosure 36 that allows the lineman to latch the enclosure 36 in the open position. As may be seen in FIG. 5, the enclosure 36 is in open position and the end of the latch rod 42 opposite the pivot 44 is removably attached to the opening in the top 36*a*. This latches the enclosure 36 in the open position. To unlatch the high voltage enclosure 36, the free end of the rod 42 is lifted out of the opening 46 in top 36*a* and the rod 42 is pivoted about pivot 44 and inserted in clip 47 mounted on the front wall 14. It is not possible to close the outer hood 26 of the transformer without first unlatching the high voltage enclosure 36 and swinging it into the closed position as shown in FIGS. 1–4. This assures that the high voltage enclosure 36 will always be in the closed position anytime the outer hood 26 is opened and it is necessary for the lineman to swing the high voltage enclosure 36 to the side as shown in FIG. 5 to gain access to the high voltage compartment and the high voltage terminals 22. This additional action meets with ANSI standards requirement that there be an additional action that the lineman must perform to gain access to the high voltage compartment of the transformer. The high low voltage barrier plate 34 is provided with a tapered slot 48 in the front end thereof for receiving a latch bolt 50 carried by the high voltage enclosure that allows for automatic closure by the simple movement of swinging the high voltage enclosure 36 to closed position. The high voltage enclosure 36 can be further secured by tightening the latch bolt 50 for securing the high voltage enclosure 36 in closed position against the barrier plate 34. If desired, a latch/padlock may also be provided. The sill 21 is attached at 21*a* and 21*b* to the opposite edges 18 and 20 of the front wall 14 of the tank 12 and cooperates with the outer hood 26 to enclose the front wall 14 of the tank, the high voltage enclosure 36, the high and low voltage terminals, 22 and 24, and the barrier plate 34.

The operation of the safety enclosure system for the transformer is as follows:

The outermost hood enclosure 26 is opened by removing the lock (not shown) from the lock tab 33*b* on sill 21 which secures the outermost hood 26 to the sill 21 and withdrawing the bolt 32 and lifting the hood 26 to the open position illustrated in FIG. 5. The pentahead latch bolt 50 on the side of the high voltage enclosure 36 is then loosened. If any additional lock has been installed, it is then unlocked. The high voltage enclosure 36 is lifted up slightly to allow the latch bolt 50 to slide out of the slot 48 in the barrier plate 34. The high voltage enclosure 36 is then swung out of the way on its hinges 40 to permit access to the high voltage terminals 22 in the high voltage compartment. The high voltage enclosure 36 is then latched in the open position, FIG. 5 by removing the free end of the latch rod 42 from the clip 47 and inserting that end into the opening 46 and on the top 36*a* of the high voltage enclosure 36.

After the lineman has completed the required work, the closure of the transformer unit 10 takes place as follows:

The free end of latch rod 42 is lifted out of the opening 46 in the top 36*a* of the high voltage enclosure 36 and returned to the clip 47 and the enclosure 36 is swung to the closed position shown in FIGS. 1–4. The high voltage enclosure 36 is secured in the closed position by the pentahead latch bolt 50. This may be supplemented by a utility lock if desired. The outer hood 26 is then rotated about its hinges 30 to the closed position illustrated in FIGS. 1–4. The pentahead bolt 32 is then secured, locking the outer hood 26 to the sill 21. This is supplemented by the utility supplied lock (not shown). An example of the supplemental lock is shown in the aforesaid U.S. Pat. No. 5,739,464. From the foregoing it will be seen that the safety enclosure system of the present invention provides increased security for any future access to the high voltage compartment of the transformer.

While there has been described a preferred embodiment of the invention, it will be understood that further modifications may be made without departing from the spirit and scope of the invention as set forth in the appended claims.

What is claimed is:

1. A safety enclosure system for a transformer comprising a transformer tank having a front wall and high voltage terminals and low voltage terminals mounted on the front wall, said system further comprising an outer hood for enclosing the high voltage terminals and the low voltage terminals, said outer hood being hinged at one edge thereof to the top of the front wall of the transformer tank for rotation about a horizontal axis between closed and open positions, a bolt for locking said outer hood in closed position, a barrier plate fixed to the front wall of the transformer tank and projecting outwardly therefrom to separate the high voltage terminals from the low voltage terminals, a high voltage enclosure hinged at one side to the front wall of the transformer tank opposite the barrier plate and covering the high voltage terminals to form a high voltage compartment, the opposite side of said high voltage enclosure being positioned adjacent said barrier plate when said high voltage enclosure is in closed position, a latch rod pivotally connected at one end to the front wall of said transformer tank and removably connected at the other end to said high voltage enclosure for latching said high voltage enclosure in an open position to expose said high voltage compartment, and a latch bolt carried by said high voltage enclosure for securing said high voltage enclosure in closed position against said barrier plate.

2. A safety enclosure system for a transformer according to claim 1 wherein said barrier plate has an outer end with slot structure in the outer end thereof for receiving said latch bolt to permit automatic closure of said high voltage enclosure by swinging the high voltage enclosure to closed position.

3. A safety enclosure system for a transformer according to claim 1 wherein said high voltage enclosure is hinged to the front wall of the transformer tank when the high voltage enclosure is in open position.

4. A safety enclosure system for a pad mounted transformer, comprising:

a tank having a front wall including a top edge and two side edges, said front wall for high voltage terminals and low voltage terminals, an outer hood pivotally attached to the top of said front wall to enclose said front wall of said tank and movable between closed and open positions, a bolt for locking said outer hood in closed position, a barrier plate fixed to said front wall of said tank and projecting outwardly therefrom to separate the high voltage terminals from the low voltage terminals, a high voltage enclosure hinged to one side of said front wall of said tank opposite said barrier plate and covering the high voltage terminals to form a high voltage compartment, the opposite side of said high voltage enclosure being positioned adjacent said barrier plate when said high voltage enclosure is in closed position, a latch rod pivotally connected at one end to the front wall of said transformer tank and removably connected at the other end to said high voltage enclosure for latching said high voltage enclosure in open position to expose said high voltage compartment, and a latch bolt carried by said high voltage enclosure for securing said high voltage enclosure in closed position against said barrier plate.

5. A safety enclosure system for a pad mounted transformer according to claim 4 including a sill attached to the opposite edges of said front wall of said tank and cooperating with said outer hood to enclose said front wall of said tank, said high voltage enclosure and said barrier plate.

* * * * *

UNITED STATES PATENT AND TRADEMARK OFFICE

CERTIFICATE OF CORRECTION

PATENT NO. : 6,066,802

DATED : May 23, 2000

INVENTOR(S) : David A. Reinke et al.

It is certified that error appears in the above-identified patent and that said Letters Patent is hereby corrected as shown below:

At Col. 4, line 43 (3rd line of claim 3), after "transformer tank" insert:

-by hinge assemblies constructed and arranged to permit the high voltage enclosure to be lifted off the transformer tank- Signed and Sealed this Third Day of April, 2001

*Attest:*

NICHOLAS P. GODICI

*Attesting Officer*

*Acting Director of the United States Patent and Trademark Office*